US005551685A

United States Patent [19]

Hori

[11] Patent Number: 5,551,685

[45] Date of Patent: Sep. 3, 1996

[54] PAPER FEED MECHANISM IN RECORDING APPARATUS

[75] Inventor: Fumihisa Hori, Takizawa-mura, Japan

[73] Assignee: Alps Electric Co., Ltd., Tokyo, Japan

[21] Appl. No.: 275,065

[22] Filed: Jul. 13, 1994

[30] Foreign Application Priority Data

Jul. 14, 1993 [JP] Japan ..... 5-174184

[51] Int. Cl.[6] ..... B65H 9/04

[52] U.S. Cl. ..... 271/245; 271/109; 400/629; 400/630

[58] Field of Search ..... 271/10.09, 124, 271/121, 245, 246, 109, 902, 126; 400/624, 629, 630

[56] References Cited

U.S. PATENT DOCUMENTS

| | | | |
|---|---|---|---|
| 4,717,136 | 1/1988 | Rutishauser | 271/902 |
| 5,050,858 | 9/1991 | Nakamura | 271/265.01 |
| 5,114,133 | 5/1992 | Osada et al. . | |

FOREIGN PATENT DOCUMENTS

| | | | |
|---|---|---|---|
| 2244264 | 11/1991 | United Kingdom | 271/121 |

*Primary Examiner*—William E. Terrell
*Assistant Examiner*—Tamara Kelly
*Attorney, Agent, or Firm*—Guy W. Shoup; Patrick T. Bever

[57] ABSTRACT

The present invention relates to a paper feed mechanism in a recording apparatus which paper feed mechanism permits the reduction in size of the entire apparatus. The paper feed mechanism comprises a main roller 3 which is rotated in both forward and reverse directions for conveying sheets of paper P from a paper receptacle portion to a recording portion, a paper separating and feeding member 20 which comes into pressure contact with the main roller 3 to separate and feed the sheets of paper P accommodated in the paper receptacle portion, and a stop member 30 which comes into pressure contact with the main roller 3 on a downstream side with respect to the paper separating and feeding member 20 in the paper conveyance direction to forcibly stop the feed of the sheets P being fed continuously. By the paper feed mechanism of such a construction, the plural sheets of paper stacked in the paper receptacle portion are separated one by one and fed to the recording portion.

5 Claims, 8 Drawing Sheets

PAPER FEED MECHANISM IN RECORDING APPARATUS

BACKGROUND OF THE INVENTION (1) Field of the Invention

The present invention relates to a paper feed mechanism for conveying sheets of paper from a paper receptacle portion to a recording portion in a recording apparatus such as a printer or a facsimile. Particularly, the present invention is concerned with a paper feed mechanism for feeding sheets of paper in a separated state one by one.

(2) Description of the Prior Art

A conventional paper feed mechanism used in a printer or the like will first be explained with reference to FIG. 12.

The paper feed mechanism 61 shown in FIG. 12 is mounted in a printer 10 and in this state it feeds sheets of paper one by one to a paper feed port 11 of the printer 10.

A paper stacker 62 in the paper feed mechanism 61 is urged upward by means of a plate spring 63 disposed on the underside of the stacker, whereby the top sheet in the stacker is pressed against a paper feed roller 64. In this state, the paper feed roller 64 is driven by a drive source (not shown), and by the rotation of the driving roller 64 the sheets of paper stacked in the paper stacker 62 are separated one by one and fed to the paper feed port 11 of the printer 10. Each sheet of paper thus fed to the paper feed port 11 is then conveyed to a recording portion 12 by the action of a paper feed roller 13 in the printer 10 and that of small rollers 14 and 15 in the printer which are in pressure contact with the paper feed roller 13. After recording in the recording portion 12, each sheet of paper is moved between a paper discharge roller 65 and a paper discharge guide 66 which is in pressure contact with the roller 65 and is then conducted into a paper discharge tray 67, by means of the paper discharge roller 65.

However, since the above conventional paper feed mechanism 61 is mounted on the printer 10 as a separate body from the printer and in this state there are performed separation and conveyance of paper, the entire apparatus becomes large-sized and thus it has been impossible to meet the recent demand for the reduction of size.

SUMMARY OF THE INVENTION

It is an object of the present invention to provide a paper feed mechanism in a recording apparatus capable of solving the problem involved in the foregoing conventional mechanism and attaining the reduction in size of the entire apparatus.

It is another object of the present invention to provide a paper feed mechanism in a recording apparatus having a paper receptacle portion in which are accommodated plural sheets of paper, a recording portion for recording information on each sheet of paper and further having the paper feed mechanism for conveying the sheets of paper one by one from the paper receptacle portion to the recording portion, the said paper feed mechanism including a main roller which is driven for rotation in both forward and reverse directions, a paper separating and feeding mechanism for separating and feeding the sheets of paper accommodated in the paper receptacle portion, and a stop member which comes into pressure contact with the main roller on a downstream side with respect to the paper separating and feeding member in the paper conveying direction to forcibly stop the feed of paper being fed continuously.

It is a further object of the present invention to provide a paper feed mechanism in the above recording apparatus wherein as the above paper separating and feeding member there is used a sub roller capable of rotating by only a predetermined angle following the rotation of the above main roller, and as the above stop member there is used a stop roller capable of rotating by only a predetermined angle larger than the rotatable angle of the sub roller following the rotation of the main roller.

It is a still further object of the present invention to provide a paper feed mechanism in the above recording apparatus wherein the rotatable angle of the above sub roller is up to an angle at which the front ends of paper sheets in the above paper receptacle portion pass the sub roller, and the rotatable angle of the above stop roller is up to an angle at which the front end of at least the top sheet out of the paper sheets which have passed the sub roller passes the stop roller.

It is a still further object of the present invention to provide a paper feed mechanism in the above recording apparatus wherein the above sub roller is constituted by mounting a roller body formed of a friction material onto the outer peripheral surface of a roller shaft, and the above stop roller comprises a roller body having a cut-out formed in the outer peripheral surface thereof for abutment of the front end of paper with the cut-out.

It is a still further object of the present invention to provide a paper feed mechanism in the above recording apparatus wherein a separation pad formed of a friction material is attached to the above sub roller on the side opposed to the above main roller, and the above stop roller comprises a roller body having a cut-out formed in the outer peripheral surface of the roller body for abutment of the front end of paper with the cut-out.

According to the paper feed mechanism in the recording apparatus of the present invention, first the main roller is rotated in the direction opposite to the paper conveying direction to move all sheets of paper back to the upstream side of the sub roller. Then, the main roller is rotated in the paper conveying direction. As a result, the sub roller which is in pressure contact with the main roller rotates by only a certain angle, and the front ends of plural sheets of paper pass the sub roller during such rotation of the sub roller. Since the rotation of the main roller is continued even after rotation of the sub roller has stopped, the front end of the top sheet of paper which is in direct contact with the main roller reaches the stop roller. At this time, since the stop roller whose rotatable angle is larger than that of the sub roller still continues rotating, the front end of the top sheet of paper passes the stop roller. Thereafter, the stop roller stops rotation. However, since the main roller is still continuing its rotation, the conveyance of the top sheet of paper is continued, which sheet reaches the printing portion. After the rear end of the top sheet passes the sub roller, the next sheet of paper which is in contact with the main roller is conveyed toward the stop roller because the rotation of the main roller is continued despite the sub roller being stopped. In this state, however, since the rotation of the stop roller has already stopped, the next sheet of paper comes into abutment with the outer peripheral surface of the stop roller and stops, not conveyed toward the recording portion.

BRIEF DESCRIPTION OF THE DRAWINGS

FIGS. 2(*b*) and 2(*c*) are front and side views of a sub roller of the apparatus shown in FIG. 2(*a*);

FIGS. 2(*d*) and 2(*e*) are front and side views of a stop roller of the apparatus shown in FIG. 2(*a*);

FIG. 2(*f*) is a section view taken through a side wall of a roller unit of the apparatus shown in FIG. 2(*a*);

DETAILED DESCRIPTION OF THE PREFERRED EMBODIMENTS

The present invention will be described hereinunder by way of embodiments thereof illustrated in the accompanying drawings.

Figure 1:
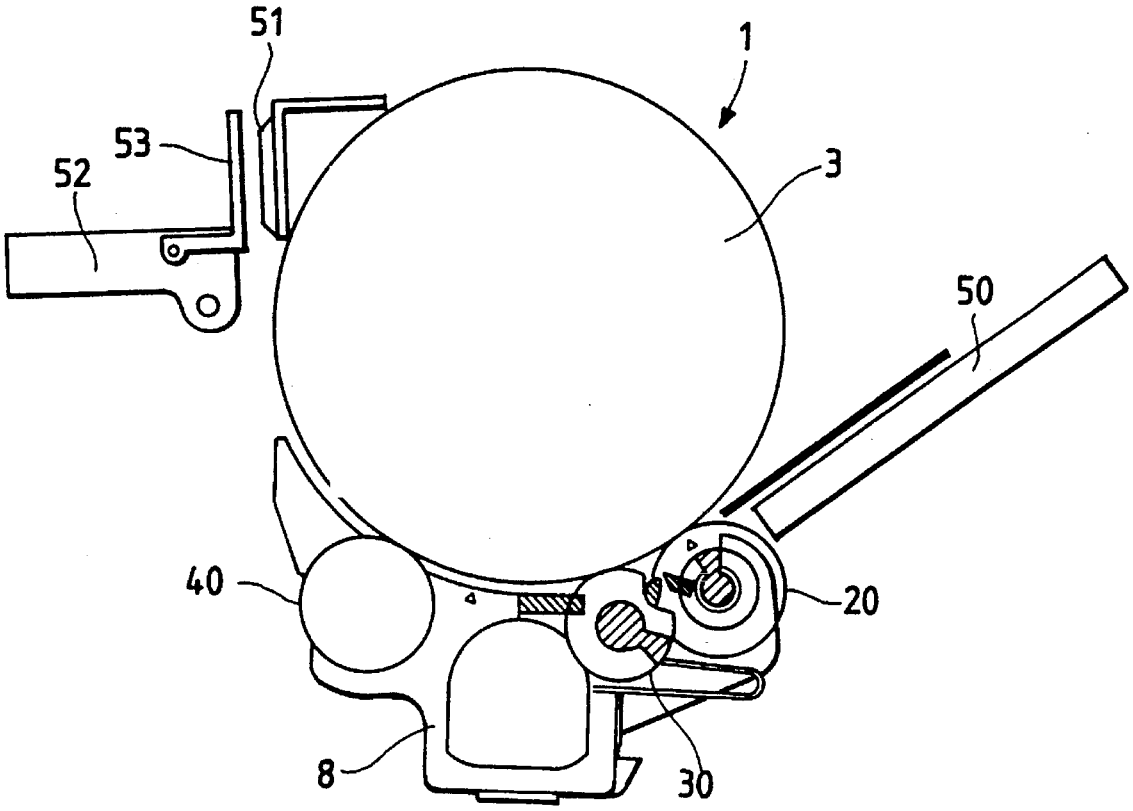
FIG. 1 is a sectional side view showing the entire construction of a recording apparatus in the first embodiment of the present invention.
Figure 2A:
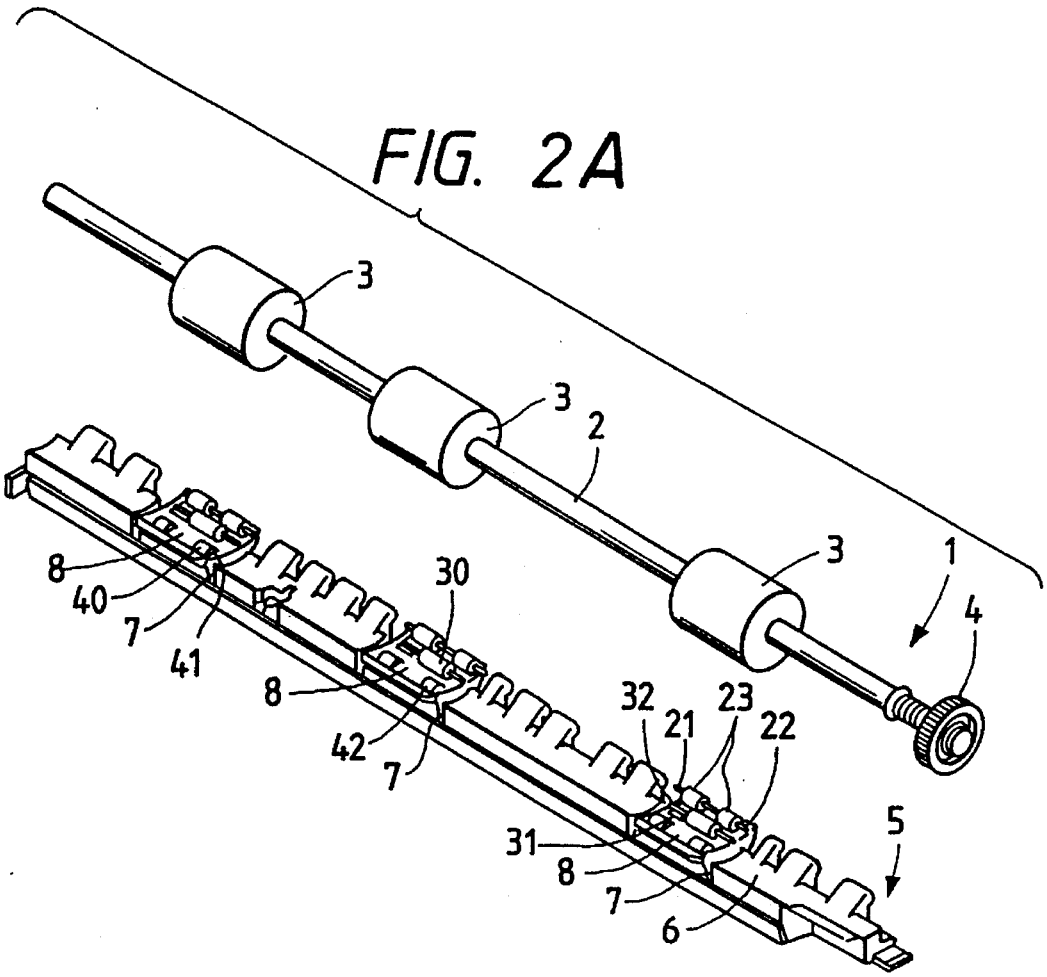
FIG. 2(*a*) is an exploded perspective view showing a principal portion in the first embodiment.

FIGS. 1 to 7 illustrate the first embodiment of the present invention. First, the construction of the first embodiment will be described with reference to FIGS. 1 and 2. FIG. 1 is a sectional side view showing the entire construction of a recording apparatus in the first embodiment and FIG. 2 is an exploded perspective view of a paper feed mechanism used therein. The recording apparatus has a main roller assembly 1 for paper conveyance, a paper receptacle portion 50 for storage of plural sheets of paper therein, and a recording portion comprising a platen 51 and a printing head 53 mounted on a carriage 52.

Under the main roller assembly 1 is disposed a paper guide means 5 to be described later which guide means is provided with a roller unit 8, the roller unit 8 including a sub roller 20 as a paper separating and feeding member, a stop roller 30 as a stop member for forcibly stopping the feed of paper being fed continuously, and a small roller 40 which conveys the separated and fed sheets of paper to the recording portion in cooperation with a main roller 3 which constitutes the main roller assembly 1.

As to the structure of this paper feed mechanism, it will be described later in more detail.

In FIG. 2, which is an exploded perspective view of the paper feed mechanism, the main roller assembly 1 comprises a plurality (three in this embodiment) of main rollers 3,3, . . . formed of a friction material such as rubber and mounted on a rotary shaft 2 spacedly in the axial direction of the rotary shaft. The main rollers 3 are each in a cylindrical shape of the same outside diameter.

A gear 4 is fitted on one end of the rotary shaft 2 and it is connected through a gear (not shown) to an output shaft of a motor (not shown) capable of rotating forward and reverse. As the motor rotates either forward or reverse, the main rollers 3 also rotate in the same direction.

Under the main roller assembly 1 is disposed the paper guide means 5 which is long and extends in parallel with the rotary shaft 2. The paper guide means 5 has an upward guide surface 6 for actually guiding paper. The guide surface 6 is formed in a concave shape whose diameter is a little larger than the outside diameter of each main roller 3, and in positions of the guide surface 6 opposed to the main rollers 3 there are formed recesses 7 respectively. In each recess 7 is fitted a roller unit 8, the roller unit 8 comprising a sub roller 20 as a paper separating and feeding member for separating and feeding the sheets of paper accommodated in the paper receptacle portion 50 shown in FIG. 1, a stop roller 30 as a stop member for forcibly stopping the feed of paper being fed continuously, and a small roller 40 for conveying the separated and fed sheets of paper to the recording portion in cooperation with the main roller 3. The sub roller 20, stop roller 30 and small roller 40 are arranged in this order from the upstream side to the downstream side in the conveyance direction of paper P.

The paper feed mechanism of this embodiment will be described below in detail with reference to FIGS. 2 to 7. FIGS. 3 to 7 are sectional side views of a principal portion for explaining the structure and operation of the paper feed mechanism.

As shown in FIGS. 2(*b*), 2(*c*) and 2(*f*), the sub roller 20 has a roller shaft 21 which is rotatably supported at both ends thereof by bearing recesses 22 formed in the roller unit 8 and also has two cylindrical roller bodies 23, 23 formed of a friction material and mounted on the roller shaft 21 so as to avoid coincidence with a roller body 33 of the stop roller 30. One end of the roller shaft 21 is formed with a projection 24 projecting radially outwards. In the roller unit 8 there are mounted a pair of stoppers 25, 25 adapted to come into abutment with the projection 24 to restrict the rotatable angle of the roller shaft 21 up to an angle at which the front end of paper P in the paper receptacle portion (not shown) passes the sub roller 20.

The stop roller 30, as shown in FIGS. 2(*d*), 2(*e*) and 2(*f*) has a roller shaft 31 extending in parallel with the rotary shaft 2 of the main roller assembly 1. Both ends of the roller shaft 31 are supported rotatably in a pair of bearing recesses 32, 32 formed in the roller unit 8. A cylindrical roller body 33 formed of a friction material is mounted on a central part in the axial direction of the roller shaft 31 so as avoid coincidence with the roller bodies 23 of the sub roller 20. In the outer peripheral surface of the roller body 33 is formed a cut-out 34 extending in parallel with the axis of the roller shaft 31. The front end of paper P can come into abutment of the cut-out 34.

At one end of the roller shaft 31 is formed a projection 35 projecting radially outwards, while stoppers 36, 36 with which the projection 35 can come into abutment are provided projectingly in the roller unit 8 in positions close to the bearing recesses 22. A rotatable angle of the roller shaft 31 is restricted up to an angle at which the front end of only the top sheet of paper after passing the sub roller 20 passes the stop roller 30 upon abutment of the projection 35 with one stopper 36 with rotation of the roller shaft 31.

When each main roller 3 has rotated in the normal paper P conveying direction and the projection 35 of the stop roller 30 which rotates following the main roller has come into abutment with the stopper 36 to stop the rotation of the stop roller 30, the cut-out 34 of the roller body 33 is in a position adjacent to the outer peripheral surface of the main roller 3 and faces backward so that it can receive therein the front end of the succeeding paper P.

In the roller unit 8, moreover, there is supported a plate spring 37 for bringing the sub roller 20, stop roller 30 and small roller 40 into pressure contact with the outer peripheral surface of the associated main roller 3.

The small roller 40, as shown in FIG. 2, has a roller shaft 41 extending in parallel with the rotary shaft 2 of the main roller assembly 1. Both ends of the roller shaft 41 are supported rotatably in a pair of bearing recesses 42, 42 which are formed in the roller unit 8. Further, cylindrical roller bodies 43 formed of a friction material are mounted on both axial ends of the roller shaft 41. The small roller 40 normally rotates following the rotation of the main roller 3.

Figure 3:
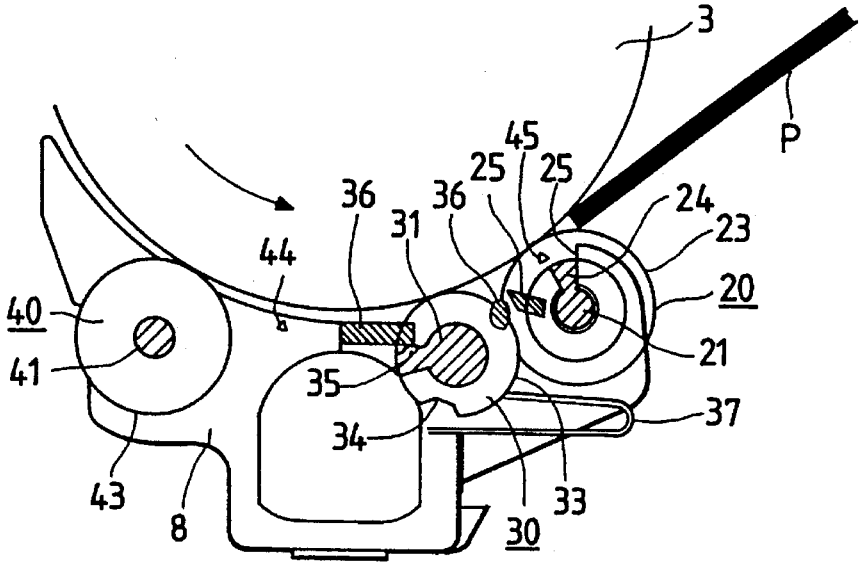
FIG. 3 is an explanatory view for explaining the structure and operation of a paper feed mechanism in the first embodiment.
Figure 2B:
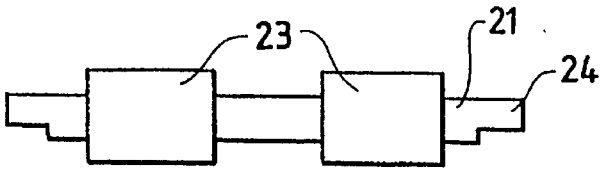
Figure 2C:
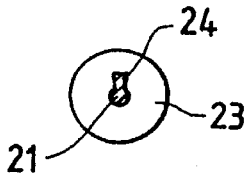
Figure 2D:
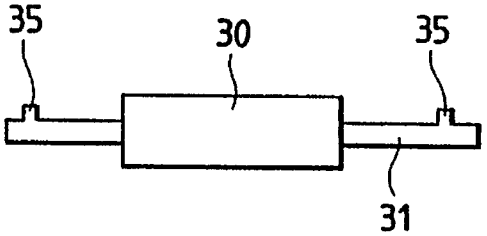
Figure 2E:
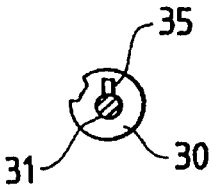
Figure 2F:
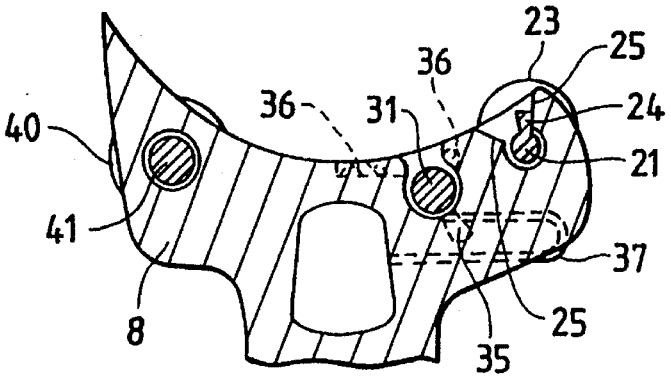
Figure 4:
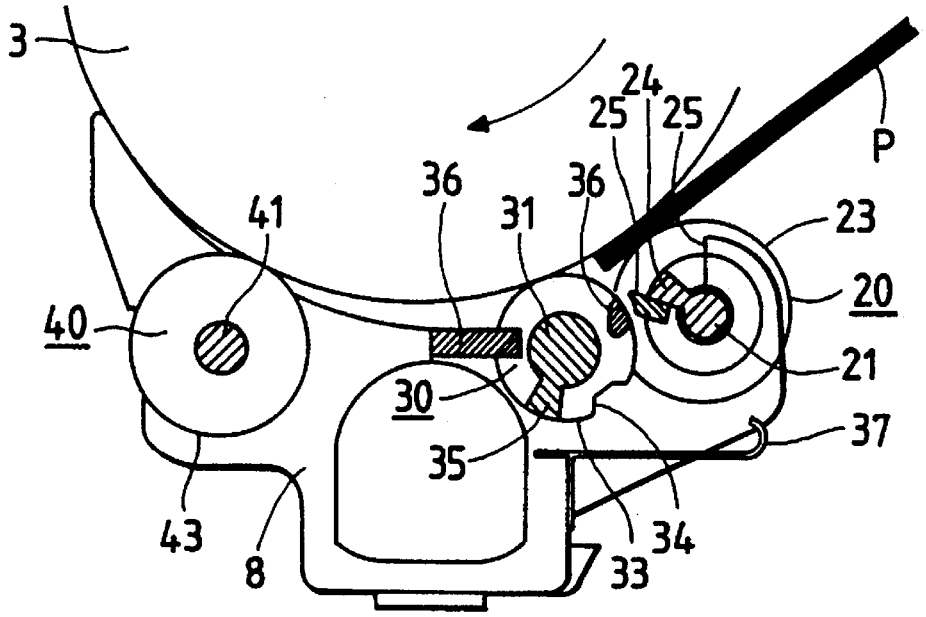
FIG. 4 is an explanatory view for explaining the structure and operation of the paper feed mechanism in the first embodiment.

In the vicinity of the sub roller 20 in the roller unit 8 and between the stop roller 30 and the small roller 40 there are disposed paper sensors 44 and 45 for detecting the presence of paper in those portions, as shown in FIG. 3.

Reference will be made below to the operation of this embodiment constructed as above.

When power is ON and the paper sensors 44 and 45 have detected the presence of paper P, each main roller 3 is rotated in the clockwise direction to discharge the paper P. Then, after the paper discharge is over, as shown in FIG. 3, the main roller 3 is rotated in the counterclockwise direction, causing the sub roller 20 and the stop roller 30 to revert to their initial positions, as shown in FIG. 3. When in this state the main roller 3 is rotated clockwise in FIG. 4 to convey the paper P in the normal conveyance direction, the sub roller 20 whose roller body 23 is in pressure contact with the main roller 3 rotates by only a certain angle following the rotation of the main roller, and during this rotation of the sub roller 20 the front ends of plural sheets of paper P pass the sub roller. In this state the rotation of the sub roller 20 is stopped, but since the main roller 3 continues to rotate even after the sub roller 20 has stopped rotation, the front end of the top sheet P which is in direct contact with the main roller reaches the stop roller 30. At this time, the stop roller 30 whose rotatable angle is larger than that of the sub roller 20 still continues rotating, so that the front end of the top sheet passes the stop roller.

Figure 5:
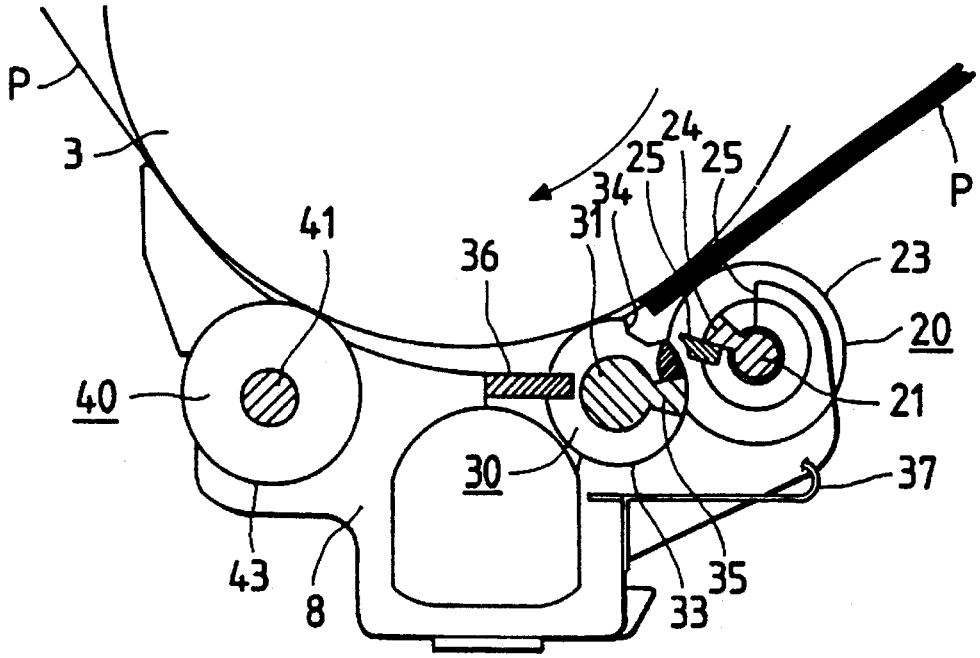
FIG. 5 is an explanatory view for explaining the structure and operation of the paper feed mechanism in the first embodiment.

Thereafter, the stop roller 30 stops rotation, but since the main roller 3 still continues rotating, the conveyance of the top sheet P is continues as long as the rotation of the main roller 3 is continued. Consequently, the sheet P reaches the printing portion and is used for printing, as shown in FIG. 5.

After the rear end of the top sheet P has passed the sub roller 20, the next sheet P which is in contact with the main roller 3 is conveyed toward the stop roller 30 due to continued rotation of the main roller 3 despite the sub roller 20 being stopped. But in this state the stop roller 30 has already stopped rotation, so the front end of the next sheet P abuts the cut-out 24 of the stop roller 20 and stops, as shown in FIG. 5. Therefore, the next sheet P is not conveyed toward the recording portion.

Figure 6:
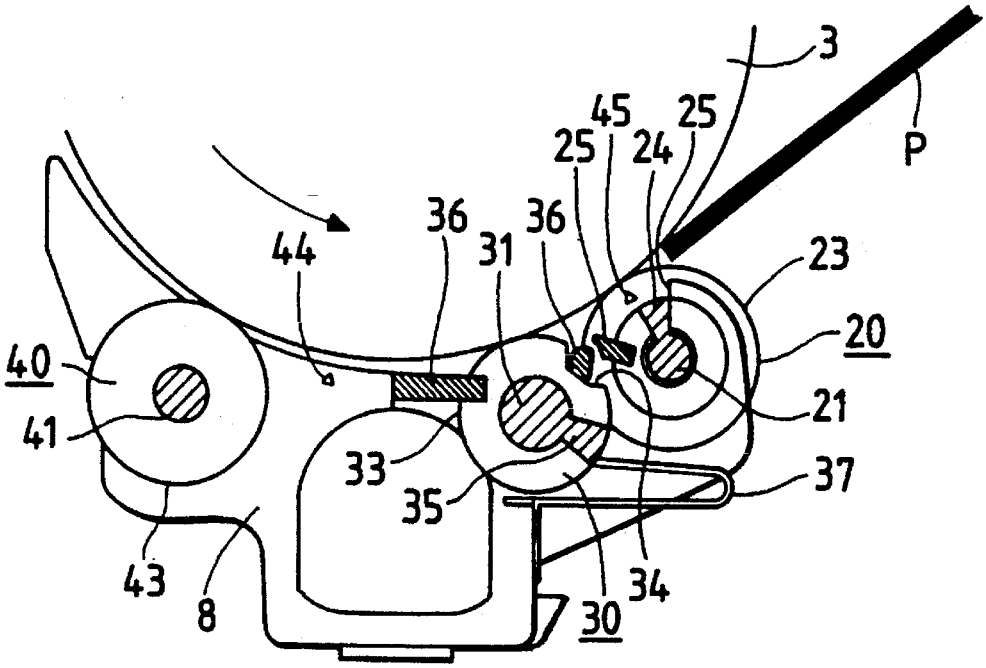
FIG. 6 is an explanatory view for explaining the structure and operation of the paper feed mechanism in the first embodiment.
Figure 7:
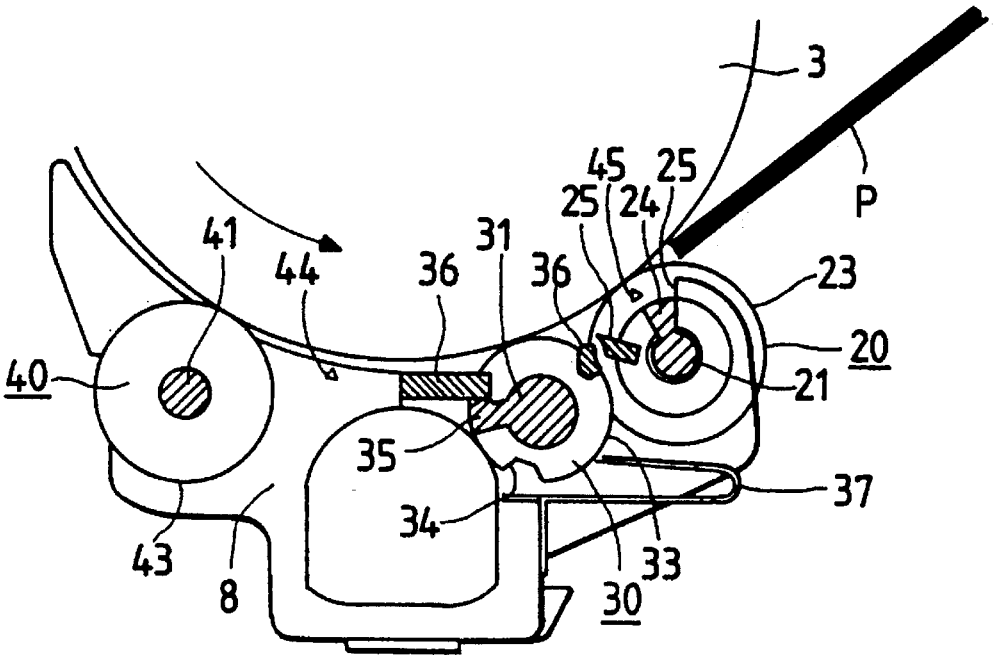
FIG. 7 is an explanatory view for explaining the structure and operation of the paper feed mechanism in the first embodiment.

Next, as shown in FIG. 6, when the main roller 3 is rotated in the reverse direction, the sub roller 20 and the stop roller 30 revert to their initial states illustrated in FIG. 7, and the next sheet P which has been slightly conveyed by the rotation of the main roller 3 is also conveyed in the reverse direction and comes into a completely tapped state with the other sheets of paper.

Now, the next recording can be done by repeating the above operations from the initial state shown in FIG. 7 similar to FIG. 3.

Referring now to FIGS. 8 to 11, there is illustrated a second embodiment of the present invention. The construction of this embodiment is the same as that of the first embodiment except that the sub roller used in this embodiment is different in construction from the sub roller used in the first embodiment. Therefore, only the constructional point different from the first embodiment will be described below, while as to the other constructional points common to the first embodiment, they are indicated in the drawings by the same reference numerals as in the first embodiment and the explanation thereof will be omitted.

The sub roller used in this embodiment, which is indicated at 20A, has a roller shaft 21A extending in parallel with the rotary shaft 2 of the main roller assembly 1. Both ends of the roller shaft 21A are rotatably supported in the paired bearing recesses 22, 22 formed in the roller unit 8. A separation pad 23A is mounted on the roller shaft 21A at a central part in the axial direction of the roller shaft and on the side opposed to the main roller 3. The separation pad 23A is constituted by a block of a friction material having a cylindrical outer peripheral surface whose outside diameter is close to that of the main roller 3. Other constructional points are the same as in the first embodiment.

The operation of this second embodiment having the above construction will be described below.

Figure 8:
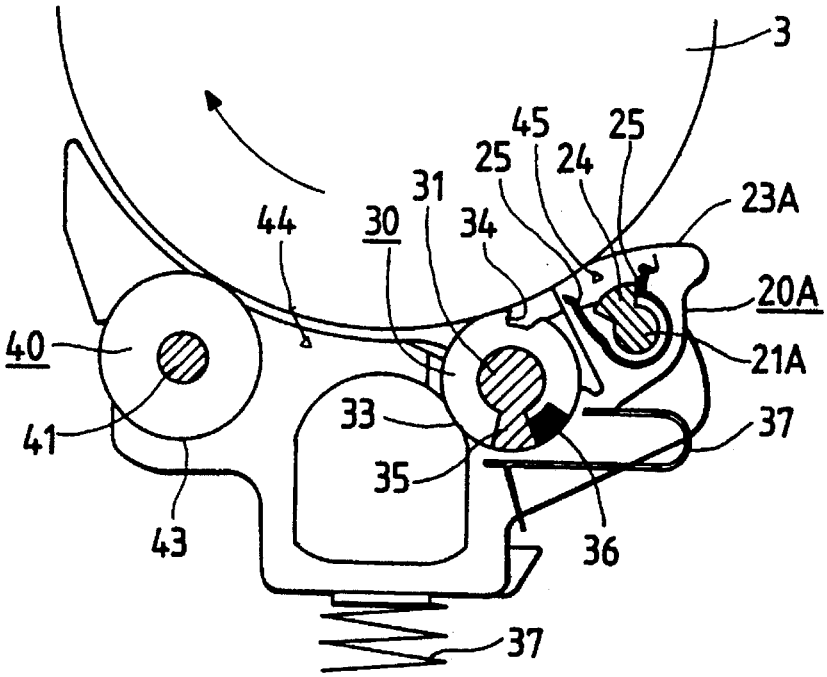
FIG. 8 is an explanatory view for explaining the structure and operation of a paper feed mechanism in the second embodiment of the present invention.

When both paper sensors 44 and 45 have detected the presence of paper P upon application of electric power, each main roller 3 is rotated clockwise in FIG. 8 to convey the paper in the normal conveyance direction, whereby the remaining paper is discharged completely.

At this time, the sub roller 20A and the stop roller 30 cannot rotate following the rotation of the main roller 3, but out of plural sheets of paper (not shown) which are accommodated in the paper receptacle portion and whose front ends face the vicinity of the sub roller, the top sheet positioned on the main roller 3 side is conveyed with the rotation of the main roller 3 so that its front end passes the sub roller 20A. At this time, however, since the cut-out 34 of the roller body 33 of the stop roller 30 is in a position adjacent to the outer peripheral surface of the main roller 3 and faces backward so as to receive the front end of the succeeding sheet therein, the front end of the top sheet abuts the cut-out 34 of the stop roller 30 and stops.

Thereafter, the main roller 3 is rotated counterclockwise in FIG. 8, causing the sub roller 20A and the stop roller 30 to rotate so as to revert to their initial positions. At this time, the top sheet whose front end is positioned within the cut-out 34 of the stop roller 30 is also returned to its original state. The sub roller 20A and the stop roller 30 thus returned to their initial states are shown in FIG. 9.

Figure 9:
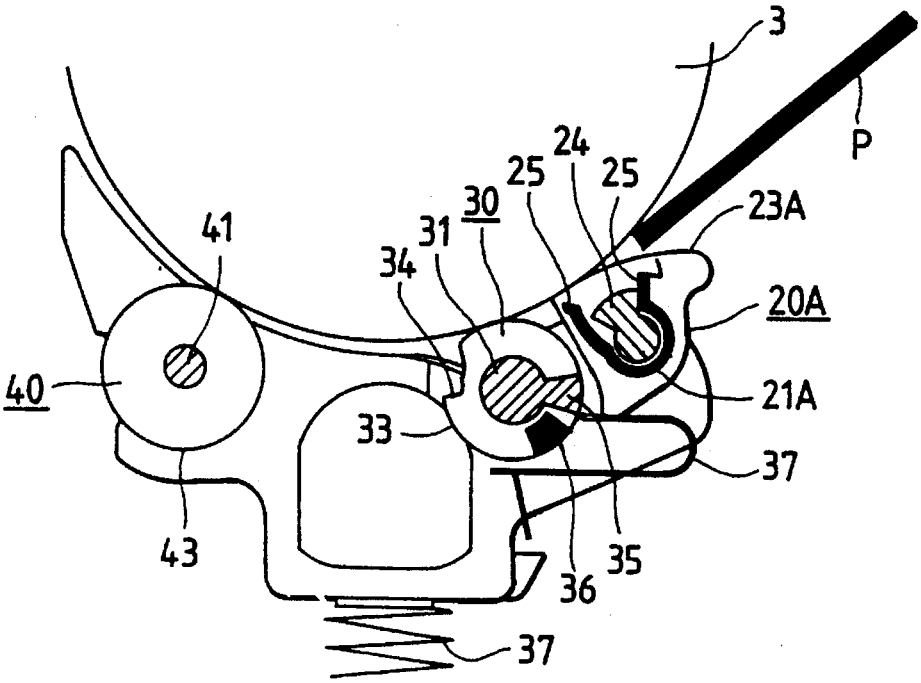
FIG. 9 is an explanatory view for explaining the structure and operation of the paper feed mechanism in the second embodiment.

In the initial state illustrated in FIG. 9, the front ends of plural sheets of paper P positioned within the paper receptacle portion (not shown) are positioned between the main roller 3 and the separation pad 23A of the sub roller 20A.

Figure 10:
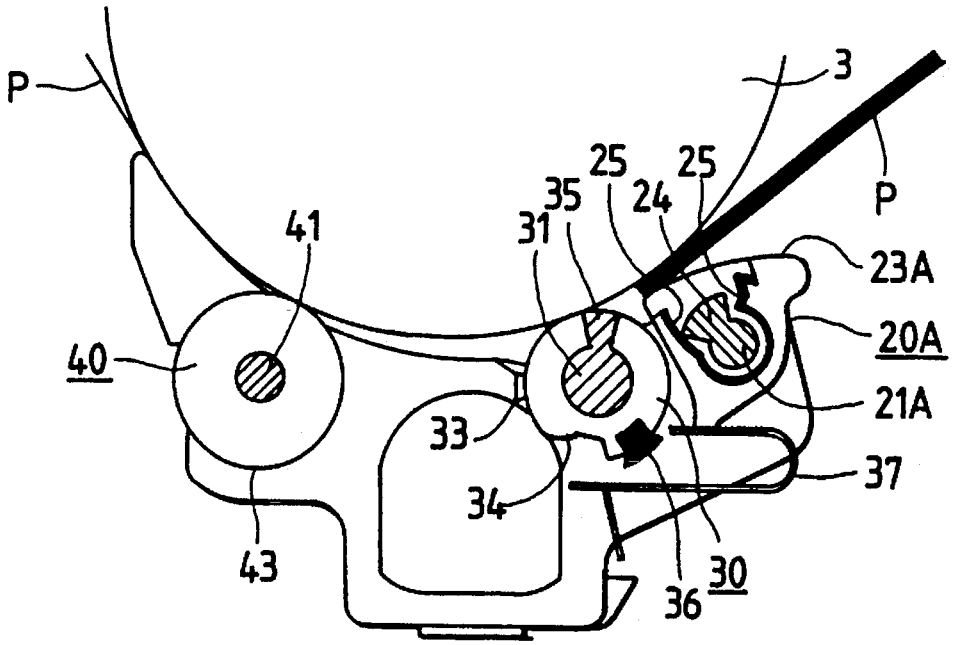
FIG. 10 is an explanatory view for explaining the structure and operation of the paper feed mechanism in the second embodiment.

When in this state the main roller 3 is rotated clockwise in FIG. 9 to convey the sheets of paper in the normal conveyance direction, the sub roller 20A with the separation pad 23A in pressure contact with the main roller 3 rotates by only a certain angle, and during this rotation of the sub roller 20A the front ends of plural sheets of paper P pass the sub roller. In this state the rotation of the sub roller 20A is stopped, but the rotation of the main roller 3 is continued even after the rotation of the sub roller has stopped, so the front end of the top sheet which is in direct contact with the main roller 3 reaches the stop roller 30. At this time, since the stop roller 30 whose rotatable angle is larger than that of the sub roller 20A keeps on rotating, the front end of the top sheet passes the stop roller 30, as shown in FIG. 10.

Thereafter, the rotation of the stop roller 30 stops, but since the main roller 3 continues rotating, the conveyance of the top sheet is continued as long as the main roller continues to rotate, so that this sheet P reaches the printing portion and is used for printing.

Figure 11:
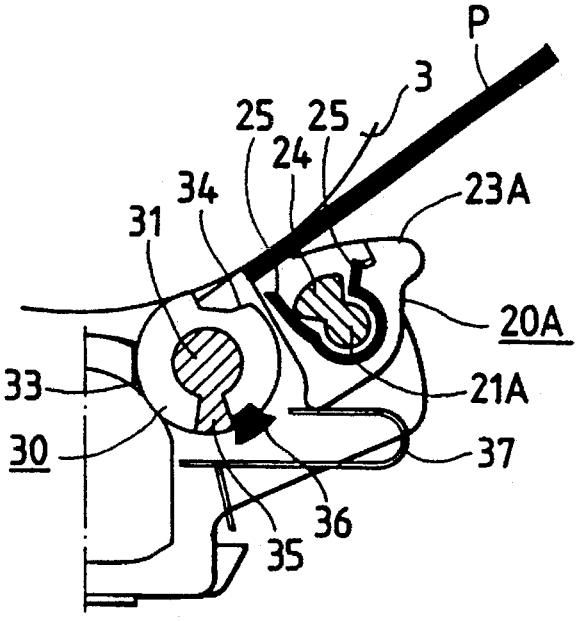
FIG. 11 is an explanatory view for explaining the structure and operation of the paper feed mechanism in the second embodiment.
Figure 12:
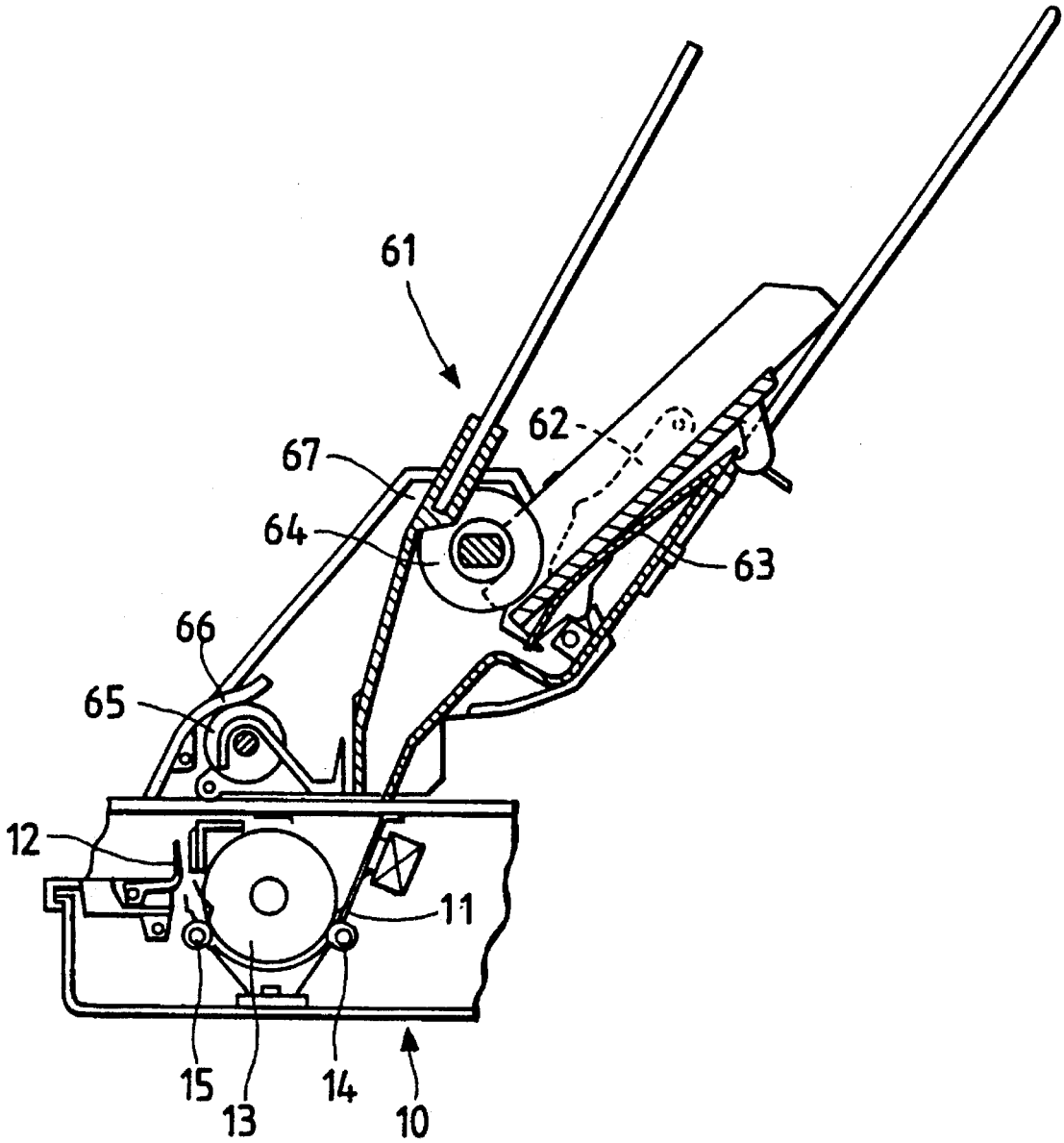
FIG. 12 PRIOR ART
FIG. 12 is a sectional side view showing a recording apparatus with a conventional paper feed mechanism applied thereto.

After the top sheet P has passed the sub roller 20A, the next sheep P which is in contact with the main roller 3 is conveyed toward the stop roller 30 due to continued rotation of the main roller despite the sub roller being stopped. In this state, however, since the stop roller 30 has already stopped rotation, the front end of the next sheet P abuts the cut-out 34 of the stop roller and stops, as shown in FIG. 11, so that the next sheet is not conveyed toward the recording portion.

Next, when the main roller 3 is rotated in the reverse direction, the sub roller 20A and the stop roller 30 revert to their initial states shown in FIG. 9, and the next sheet P which has been slightly conveyed by the rotation of the main roller 3 is also conveyed in the reverse direction and comes into a completely tapped state with the other sheets of paper.

The next recording can be done by repeating the above operations from the initial state shown in FIG. 9.

According to this embodiment described above, since the conveyance of paper from the paper receptacle portion to the recording portion is performed by using the main rollers 3 in the recording apparatus, a compact construction can be realized and it is possible to attain the reduction in size of the entire apparatus. Further, by rotating the main rollers 3 in both forward and reverse directions, only one sheet of paper can be surely separated from the other sheets and conveyed to the recording portion.

Thus, also by this second embodiment there can be attained substantially the same function and effect as in the first embodiment.

It goes without saying that the present invention is not limited to both embodiments described above and that various modifications may be made as necessary.

According to the present invention, as set forth above, the reduction in size of the entire apparatus can be attained because the separation and conveyance of paper can be done by using the main rollers in the recording apparatus. Besides, the separation of paper can be further ensured by forming a cut-out in the stop roller.

I claim:

1. A paper feed mechanism in a recording apparatus having a paper receptacle portion containing plural sheets of paper, a recording portion for recording information on the sheets of paper and the paper feed mechanism for conveying the sheets of paper one by one from said paper receptacle portion to said recording portion, said paper feed mechanism comprising a main roller adapted to be rotated in both forward and reverse directions for conveying the sheets of paper from said paper receptacle portion to said recording portion, a paper separating and feeding member which comes into pressure contact with said main roller to separate and feed the sheets of paper accommodated in said paper receptacle portion, and a stop member which comes into pressure contact with said main roller on a downstream side with respect to said paper separating and feeding member in the paper conveyance direction to forcibly stop the feed of the sheets being fed continuously.

2. A paper feed mechanism in a recording apparatus according to claim 1, wherein as said paper separating and feeding member there is used a sub roller capable of rotating by only a predetermined angle following the rotation of said main roller, and as said stop member there is used a stop roller capable of rotating by only a predetermined angle larger than the rotatable angle of said sub roller following the rotation of said main roller.

3. A paper feed mechanism in a recording apparatus according to claim 2, wherein the rotatable angle of said sub roller is up to an angle at which the front ends of the sheets in said paper receptacle portion pass the sub roller, and the rotatable angle of said stop roller is up to an angle at which the front end of at least the top sheet out of the sheets which have passed the sub roller passes the stop roller.

4. A paper feed mechanism in a recording apparatus according to claim 3, wherein said sub roller is constituted by a roller body formed of a friction material and mounted on the outer peripheral surface of a roller shaft, and said stop roller is constituted by a roller body whose outer peripheral surface is formed with a cut-out for abutment with the front end of paper.

5. A paper feed mechanism in a recording apparatus according to claim 3, wherein a separation pad formed of a friction material is attached to said sub roller on the side opposed to said main roller, and said stop roller is constituted by a roller body whose outer peripheral surface is formed with a cut-out for abutment with the front end of paper.

* * * * *